US005706928A

United States Patent [19]

Neukam

[11] Patent Number: 5,706,928

[45] Date of Patent: Jan. 13, 1998

[54] PICKING SYSTEM

[75] Inventor: Helmut Neukam, Hausmannstätten, Austria

[73] Assignee: P.E.E.M. Förderanlagen Gesellschaft m.b.H., Graz, Austria

[21] Appl. No.: 604,861

[22] Filed: Feb. 22, 1996

[30] Foreign Application Priority Data

Mar. 15, 1995 [AT] Austria ..... A 454/95

[51] Int. Cl.[6] ..... B65G 47/46

[52] U.S. Cl. ..... 198/349; 198/355; 198/350

[58] Field of Search ..... 198/349, 350, 198/355; 270/58.01

[56] References Cited

U.S. PATENT DOCUMENTS

| | | | |
|---|---|---|---|
| 2,876,888 | 3/1959 | Auliffe et al. | 198/355 |
| 3,034,634 | 5/1962 | Brand et al. | 198/355 |
| 3,049,247 | 8/1962 | Lemelson | 198/349 |
| 3,087,598 | 4/1963 | Clore | 198/350 |
| 3,126,837 | 3/1964 | Noye et al. | 198/349 |
| 3,152,681 | 10/1964 | Byrnes et al. | 198/355 |
| 3,854,889 | 12/1974 | Lemelson | 198/349 |
| 3,949,192 | 4/1976 | Kuwertz et al. | 198/349 |
| 4,832,203 | 5/1989 | Nozawa | 198/349 |
| 5,533,606 | 7/1996 | Yuyama | 198/349 |

FOREIGN PATENT DOCUMENTS 2349848 11/1974 Germany .

*Primary Examiner*—Joseph E. Valenza
*Attorney, Agent, or Firm*—Collard & Roe, P.C.

[57] ABSTRACT

Device which is part of a picking system, including a conveyor for carrying containers, a device for automatically labelling the containers, and a device for removing the labels from the containers. In order to allow a straightforward inspection of the contents of a container, the containers feature on their outside a holder, which is open on its top side, designed to hold waybills. The device for labelling the containers comprises a printer arranged above the conveyor, and the device for removing the labels comprises a suction nozzle.

5 Claims, 1 Drawing Sheet

PICKING SYSTEM

FIELD OF THE INVENTION

The invention relates to a device which is part of a system for selectively taking articles from a warehouse to combine them according to an order, such a system being known to a person skilled in the art as a picking system. The device according to the invention includes a conveying installation for containers, a device for automatically labelling these containers, and a device for removing the labels from the containers.

Automatic storekeeping systems are often structured in a way that containers are led through the warehouse on a conveyor with the according articles which are to be taken from the warehouse being dropped into the containers. Thereby, one particular container is assigned to each order. After making its way through the warehouse, the container is filled with all available single positions of the order and is ready to be prepared for shipment.

In order to provide for visual control of the process and to allow human interference, which is not entirely avoidable even with fully automated operation, it is necessary in such systems for the containers to be accordingly labelled. This is generally accomplished through waybills containing a list of all single positions designated for the according order. These waybills are either attached to or dropped into the containers.

DESCRIPTION OF THE PRIOR ART

Methods have been known where a particular electronically stored order is assigned to an empty container. This container is then carried to a printing station which prints out the waybill belonging to that order and drops it into the container. The disadvantage of such methods is that the waybill is generally dropped into the empty container and is then successively covered by the articles dropping into the container. It is therefore necessary to empty the container in order to be able to check its contents.

Furthermore, it has been proposed to employ plastic containers which are electrostatically charged in order to keep the waybills stuck to their outsides. This, however, has the disadvantage of not only the waybills sticking to the containers, but other lightweight objects, such as pieces of paper, but also dirt particles, being drawn to the containers as well. Additionally, the electrostatic charging of the containers, mostly achieved through rotating brushes, results in according wear on the containers, and unpleasent electrical discharges may result when the containers are touched by personnel.

SUMMARY OF THE INVENTION

It is the object of the present invention to avoid these disadvantages and to propose a device of the kind mentioned above which allows a straightforward and quick attachment of waybills to the outside of a container as well as removing them.

According the invention, this is accomplished in an installation of the kind mentioned above, the device for labelling the containers comprising a printer arranged above the conveyor for printing out waybills, the device for removing the label comprising a suction nozzle, and the containers featuring on their outside a holder which is open on its upper side, as known per se, for holding the waybills.

The proposed measures allow according waybills to be printed out and inserted into the holder of the container. The waybill can easily be removed from this holder by means of the suction nozzle.

From the DE 23 49 848 A, a conveyor with a destination control installation has been known with mobile overhead trolleys, which can be steered to different locations, featuring a holder for punched cards, whose punching designates the destination of the respective trolley in encoded form. Thereby, said holder is mounted vertically adjustable and features projecting studs which interact with guideways arranged in the area of an address reading station.

This known solution uses only machine-readable adress cards, which have to be manually inserted into and removed from the mounting. Thereby, since punch cards are used exclusively, a quick check of the destination of the trolleys by personnel is not possible.

In the present invention, a straightforward insertion of the waybill into the holder is made possible by arranging the holder in the area of the upper rim of the container.

A vertically adjustable delivery chute of the printer allows the waybill to be inserted into the holder directly from the printer even when the containers feature differing heights. The adjustment of the vertical position of the delivery chute and the suction nozzle may thereby ensue according to signals coming from a sensor arrangement recording the height of the incoming container.

The suction nozzle precedes the printer in the conveying path of the containers, ensuring that each old waybill is removed from the holder before a new one is inserted.

Additionally, the containers feature a permanent coding, and a data processing device which controls the delivery units is also connected to the printer. In combination with a code reader, arranged before the printer, for reading the coding of each container, the data processing device can reliably identify each container, assign a particular order to it, and have the according waybill printed out.

DETAILED DESCRIPTION OF THE INVENTION

Figure 2:
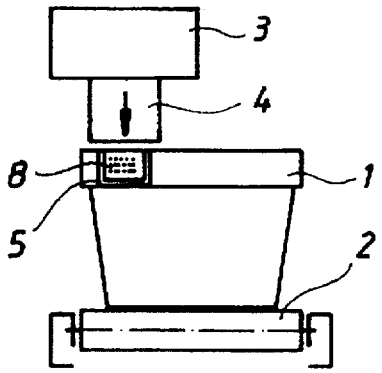
Figure 1:
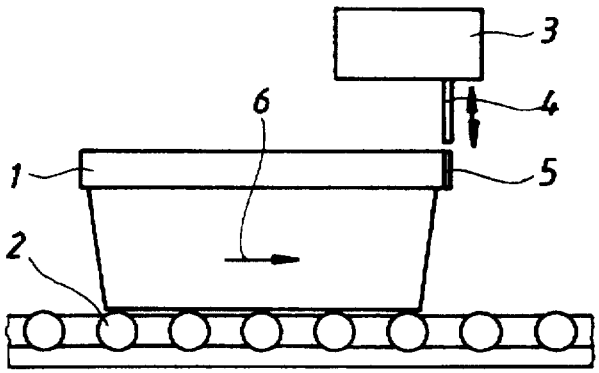
Figure 3:
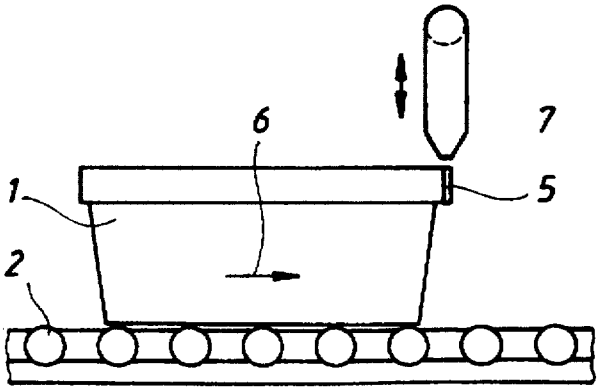

The invention will now be described in detail according to the drawing, in which:

FIG. 1 schematically shows a side view of a device according the invention for fixing an waybill to a container;

FIG. 2 schematically shows a device according FIG. 1 in frontal view;

FIG. 3 schematically shows a side view of a device for removing waybills; and

Figure 4:
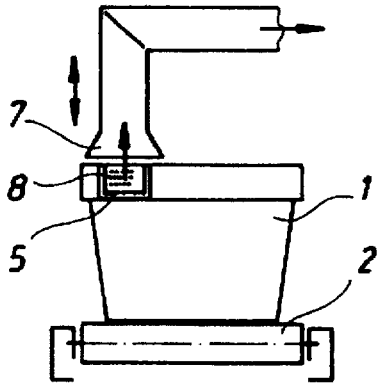

FIG. 4 schematically shows a device according FIG. 3 in frontal view.

In a device according the invention, a roller conveyor 2 is provided on which the containers 1 are carried. The containers 1, which are guided by a data processing device not illustrated in the drawing, thereby reach the area of a device for automatically labelling the single containers 1.

According FIG. 1, a printer 3, arranged above the roller conveyor 2, is provided as labelling device, and, being controlled by a data processing device (not illustrated in the drawing), printing out waybills 8 respectively assigned to the single containers 1. This printer 3 features a vertically adjustable delivery chute 4 which is controlled regarding its vertical position according to the signals from a sensing device (not illustrated in the drawing), its dispense opening being adjusted to a position slightly above the upper rim of the respective container 1. These measures make possible the usage of different containers varying in their vertical dimensions.

As can be seen in FIG. 2 and 4, a holder, which is open on its top side, is arranged on the front wall of the container 1 in the area of its upper rim.

Such a holder 5 may be constructed of profiles arranged on three sides, which hold a waybill 8 inserted into the holder 5 by partly overlapping it. However, it is also possible to provide a transparent cover attached to the container 1 at a small distance from the front wall with separators sitting close to both the front wall and the cover in several places on three sides in order to securely hold a waybill 8 and to prevent it from slipping out.

A vertically adjustable device comprising a suction nozzle 7 for removing the waybills 8 is arranged in front of the labelling device made up of the printer 3, viewed in the conveying direction. The suction nozzle 7 creates an according underpressure in the area of the holder 5, and therefore in the area of the waybill 8, the waybill 8 therefore being sucked in by the nozzle 7.

For recognizing the presence of a container 1 and recoding its size, sensors (not illustrated in the drawing) are arranged in front of the suction nozzle 7 and the printer 3, these sensors being connected to a data processing device (not illustrated in the drawing) which receives as input the data regarding a particular order and which assigns a particular container 1 to this order. The data processing unit controls the printer 3 and initiates the printing out of a corresponding waybill 8 as soon as the container 1, which features a code, reaches the area of the printer 3. As soon as the container 1 has reached a certain position, the waybill 8 is dispensed and inserted into the holder 5 of the respective container 1, the dispense opening of the delivery chute 4 having been adjusted to a vertical position corresponding to the height of the container 1. The position of the delivery chute 4 may thereby be controlled either according to signals from a sensing device recording the height of the container 1 or according to information regarding the height of the container 1 derived from the coding of the container 1 by an appropriate reading device.

After that, the container 1 is filled with the intended articles through accordingly controlled dispensing devices not (illustrated in the drawing), after which the articles can, for example, be prepared for shipment. After that, the container 1 is ready for a new order and can be conveyed to the suction nozzle 7 on the roller conveyor 2, the vertical adjustment of the nozzle 7 ensuing either according to signals from a sensing device recording the height of the container 1 or according to information regarding the height of the container 1 derived from the coding of the container 1 by an appropriate reading device. After the old waybill 8 is sucked off, the container 1 reaches the printer 3 which supplies the container 1 with a new waybill 8.

The container 1 may be stopped for the time it takes to supply it with a waybill 8 or to suck off the waybill 8, respectively. However, it is also possible to have the printer 3 and the suction nozzle 7 horizontally adjustable and to move the printer 3 and the nozzle 7 substantially synchronously with the container 1, and therefore at a constant relative position toward the holder 5, during the time it takes to supply it with a waybill 8 or to suck off the waybill 8, respectively. The movement of the printer 3 and the nozzle 7 back to their initial position may then take place at a greater speed.

I claim:

1. Device which is part of a picking system, including a conveyor (2) for containers (1), a device for automatically labelling the containers (1), and a device for removing the labels from the containers (1), characterized in that the containers (1) feature on their outside a holder (5), which is open on its top side, designed to hold waybills (8), and that the device for labelling the containers (1) comprises a printer (3) arranged above the conveyor (2), and that the device for removing the labels comprises a suction nozzle (7).

2. Device according to claim 1, characterized in that the holder (5) designed to hold the waybill (8) is arranged in the area of the upper rim of the container (1).

3. Device according to claim 1 characterized in that the printer (3) features a vertically adjustable delivery chute (4) and that the suction nozzle (7) is vertically adjustable as well.

4. Device according to claim 1, characterized in that the suction nozzle (7) precedes the printer (3) in the conveying path (6) of the containers (1).

5. Device according to claim 1 characterized in that the containers (1) feature a permanent coding and that the printer (3) is controlled by a data processing device which is connected to a code reader, arranged in front of the printer (3), for reading the code from each container (1).

* * * * *